US010408162B2

(12) United States Patent
Knollmayr et al.

(10) Patent No.: US 10,408,162 B2
(45) Date of Patent: Sep. 10, 2019

(54) CYLINDER HEAD FOR AN INTERNAL COMBUSTION ENGINE

(71) Applicant: AVL LIST GMBH, Graz (AT)

(72) Inventors: Christof Knollmayr, Graz (AT); Andreas Zurk, Weinburg (AT); Robert Pöschl, Judendorf-Strassengel (AT)

(73) Assignee: AVL List GmbH, Graz (AT)

( * ) Notice: Subject to any disclaimer, the term of this patent is extended or adjusted under 35 U.S.C. 154(b) by 200 days.

(21) Appl. No.: 14/889,735

(22) PCT Filed: Apr. 24, 2014

(86) PCT No.: PCT/EP2014/058289
§ 371 (c)(1),
(2) Date: Nov. 6, 2015

(87) PCT Pub. No.: WO2014/180661
PCT Pub. Date: Nov. 13, 2014

(65) Prior Publication Data

US 2016/0123271 A1 May 5, 2016

(30) Foreign Application Priority Data

May 8, 2013 (AT) ..... A 50312/2013

(51) Int. Cl.
*F02F 1/38* (2006.01)
*F01P 1/08* (2006.01)
(Continued)

(52) U.S. Cl.
CPC ..... *F02F 1/38* (2013.01); *F01L 3/22* (2013.01); *F01P 1/08* (2013.01); *F01P 3/14* (2013.01);
(Continued)

(58) Field of Classification Search
CPC ..... F02F 1/36; F02F 1/38; F02F 1/40; F02F 5/00; F02F 2001/248; F01P 3/12; F01L 3/22; F01L 2810/01
See application file for complete search history.

(56) References Cited

U.S. PATENT DOCUMENTS 3,822,680 A * 7/1974 Showalter ..... F01L 3/22 123/188.8
4,593,655 A * 6/1986 Mezger ..... F02F 1/40 123/188.9
(Continued)

FOREIGN PATENT DOCUMENTS

AT 006295 7/2003
CH 272380 3/1951
(Continued)

*Primary Examiner* — Grant Moubry
*Assistant Examiner* — James G Moubry
(74) *Attorney, Agent, or Firm* — Dykema Gosselt PLLC

(57) ABSTRACT

The invention relates to a cylinder head (1) for an internal combustion engine having at least one cylinder, having at least one valve seat ring (3) for a lifting valve, wherein the valve seat ring (3) is surrounded by an annular cooling channel (4) for a coolant which is formed at least partially into the cylinder head (1), wherein the cooling channel (4) surrounds the valve seat ring at least partially and extends between at least one inlet (5, 15, 25) and at least one outlet (6). In order to reduce the valve wear, it is provided that, as viewed in a section perpendicularly with respect to the axis (3*a*) of the valve seat ring (3), the cooling channel (4) has at least one preferably substantially crescent-shaped bulge (10) in the region of the inlet (5, 55, 25) and/or the outlet (6).

21 Claims, 4 Drawing Sheets

(51) Int. Cl.

| | |
|---|---|
| ***F02F 1/40*** | (2006.01) |
| ***F01L 3/22*** | (2006.01) |
| ***F01P 3/14*** | (2006.01) |
| *F02M 53/04* | (2006.01) |
| *F02F 1/24* | (2006.01) |

(52) U.S. Cl.
CPC ..... *F02F 1/40* (2013.01); *F01L 2810/01* (2013.01); *F01L 2820/02* (2013.01); *F02F 2001/248* (2013.01); *F02M 53/043* (2013.01)

(56) References Cited

U.S. PATENT DOCUMENTS

| | | | | |
|---|---|---|---|---|
| 6,776,128 | B2 * | 8/2004 | Baba | F01L 3/18 123/41.82 R |
| 7,063,051 | B2 * | 6/2006 | Schellhase | F01L 3/20 123/188.9 |
| 7,069,885 | B2 * | 7/2006 | Iida | F01P 3/16 123/41.82 R |
| 8,151,743 | B2 * | 4/2012 | Reustle | B22D 15/02 123/41.76 |
| 8,596,239 | B2 * | 12/2013 | Escriva | F01L 3/22 123/193.5 |
| 9,422,886 | B2 * | 8/2016 | Farooqui | F01L 3/02 |
| 2011/0220043 | A1 | 9/2011 | Escriva et al. | |

FOREIGN PATENT DOCUMENTS

| | | | | |
|---|---|---|---|---|
| GB | 668962 | | 3/1952 | |
| GB | 2101212 | A * | 1/1983 | F01L 3/18 |
| JP | 5715918 | | 6/1980 | |
| WO | 2008059108 | | 5/2008 | |
| WO | 2010145940 | | 12/2010 | |

* cited by examiner

CYLINDER HEAD FOR AN INTERNAL COMBUSTION ENGINE

BACKGROUND OF THE INVENTION

The invention relates to a cylinder head for an internal combustion engine having at least one cylinder, having at least one valve seat ring for a lifting valve, wherein the valve seat ring is surrounded by an annular cooing channel for a coolant which is formed at least partially into the cylinder head, wherein the cooling channel at least partially surrounds the valve seat ring and extends between at least one inlet and at least one outlet.

Known from WO 08/059108 A is a valve seat ring for a piston internal combustion engine disposed in a cylinder head, wherein a circumferential cooling channel is disposed in the valve seat ring, which cooling channel extends between an inlet and an outlet for a coolant.

Present-day high-power internal combustion engines have thermally highly stressed regions, for example in the area of the outlet valve bridges between the outlet valve seats. These regions are particularly vulnerable with respect to thermal deformation and therefore increased valve wear.

WO 2010/145 940 A1 describes a cylinder head for an internal combustion engine with annular cooling channel around outlet valve seat rings, wherein inlets and outlets of the annular cooling channels are disposed diametrically opposite in relation to the axis of the valve seat ring. Similar cooling channels around valve seats are known from DE 34 12 052 A1. These symmetrical cooling measures are however not sufficient to effectively avoid a thermal deformation of the outlet valve bridges in high-power motors.

CH 272 380 8 or GB 668 962 A each describe a valve device of an internal combustion engine with inserted valve seat ring for a poppet valve, wherein the valve seat ring is surrounded by a circumferential cooling channel which extends between an inlet and an outlet. A separating region for the coolant is formed between the inlet and the outlet, which prevents a short circuit flow between inlet and outlet A similar cooling channel has become known from JP 57-015918 U1. This cooling channel arrangement certainly allows an asymmetric cooling of the valve seat rings but the heat removal is inadequate as a result of the low flow rates. It is also disadvantageous that the separating region between inlet and outlet forms an uncooled thermal bridge and as a result, local overheating and thermal stresses can occur, in particular when the separating region is positioned close to the thermally highly loaded web between two outlet valves.

It is the object of the invention to avoid these disadvantages and reduce the valve wear.

SUMMARY OF THE INVENTION

According to the invention, this is achieved whereby the cooling channel—as viewed in a section perpendicular to the axis of the valve seat ring—has at least one preferably substantially crescent-shaped bulge in the region of the inlet and/or the outlet.

In known arrangements having an annular cooling channel, pressure losses occur in the region of the inlets and outlets, which causes a deterioration in the cooling and results in increased valve wear. As a result of the substantially crescent-shaped bulge in the region of the inlet and/or outlet, flow losses due to vortex formations and throttling effects are reduced. By this means the coolant flow rate can be increased in a simple manner and the heat removal can be improved.

Simple manufacture is obtained if the bulge at least partially has a circular segment shape and preferably can be produced by a turning tool, for example, by a milling cutter.

A targeted heat removal from thermally highly stressed regions, for example, the outlet valve bridge, can be accomplished if the bulge is disposed asymmetrically in relation to a meridian plane running through the centre of the inlet or outlet. The eccentric arrangement of the bulge in relation to the centre of the inlet or outlet results in an asymmetric division of the flow losses and therefore of the flow rates of the coolant into two branches of the cooling channel so that the heat removal from the two branches of the cooling channel is different.

The radius r of the bulge can be between 0.2 times and 0.8 times the outer radius R of the cooling channel, preferably between 0.4 times and 0.6 times the outer radius R of the cooling channel. This gives a favourable flow cross-sectional profile for the lowest possible flow losses and good cooling effect.

The inlet can open at an angle $\beta$ into the cooling channel, where the angle $\beta$ between a central line of an inlet channel leading to this inlet and a tangent to the cooling channel is spanned in the region of this inlet, where it holds for the angle $\beta$: $0 \leq \beta \leq 90°$.

Within the framework of the invention, it can be provided that at least one inlet opens radially into the cooling channel so that the angle is $\beta=90°$.

Alternatively or additionally thereto, it can be provided that at least one inlet opens tangentially into the cooling channel so that the angle is $\beta=0°$.

Furthermore, it can alternatively or additionally be provided that at least one inlet opens obliquely into the cooling channel so that for the angle $\beta$ it holds that; $0<\beta<90°$.

As a result, a clearly asymmetrically defined coolant flow can be achieved in the cooling channel. An arrangement in which the central line of the inlet channel of the sloping inlet is disposed tangentially to a circle of curvature of a bulge of a preferably radial inlet has resulted in a particularly effective heat removal.

In this case, the outlet can be disposed diametrically opposite the—preferably radial—inlet in relation to the centre of the valve seat ring, wherein preferably the central lines of the inlet and the outlet can be disposed in a meridian plane of the valve seat ring.

It is particularly advantageous for the removal of heat from thermally highly stressed regions if a plurality of inlets open into the cooling channel, wherein a preferably radial inlet in relation to the centre of the valve seat ring can be disposed diametrically with respect to the outlet and wherein the cooling channel can have at least one further inlet, which is preferably disposed on a first side of a meridian plane of the valve seat ring through the outlet facing away from an outlet valve bridge. The further inlet can be configured as a tangential inlet which opens tangentially into the cooling channel or as a sloping inlet which opens obliquely into the cooling channel. A particularly preferred embodiment of the invention in this case provides a radial inlet, a sloping inlet and a tangential inlet, wherein the radial inlet can be disposed diametrically with respect to the outlet and the two further inlets—sloping inlet and tangential inlet—can be disposed on one side of a meridian plane of the valve seat ring through the outlet—in particular on the side facing the outlet valve bridge. This brings about good heat removal from the region of the outlet valve bridge. In this case, it is particularly advantageous if at least two inlet channels are disposed so that the central lines thereof running through the respective inlets intersect at a point on a meridian plane of the valve seat ring or at a point in the region of a cooling jacket of a component preferably opening centrally into a combustion chamber, particularly preferably an injection device. An asymmetric cooling with optimal heat removal from the outlet valve bridge can be specifically achieved by this arrangement.

Each inlet is in this case in flow communication with one cast or drilled inlet channel each, the outlet is in flow communication with a cast or drilled outlet channel of the cylinder head.

In a particularly advantageous embodiment of the invention it is provided that the cooling channel of the valve seat ring is separated from the cooling system of the remaining cylinder head. It is thereby possible to use other pressures or cooling media for cooling the valve seat ring than for example for cooling the cylinder head. In particular, in this case the inlet and the outlet can be connected to the lubricating oil system of the internal combustion engine.

BRIEF DESCRIPTION OF THE DRAWINGS

The invention is explained in detail hereinafter with reference to the figures. In the figures.

DETAILED DESCRIPTION OF THE DEPICTED EMBODIMENTS

Figure 1:
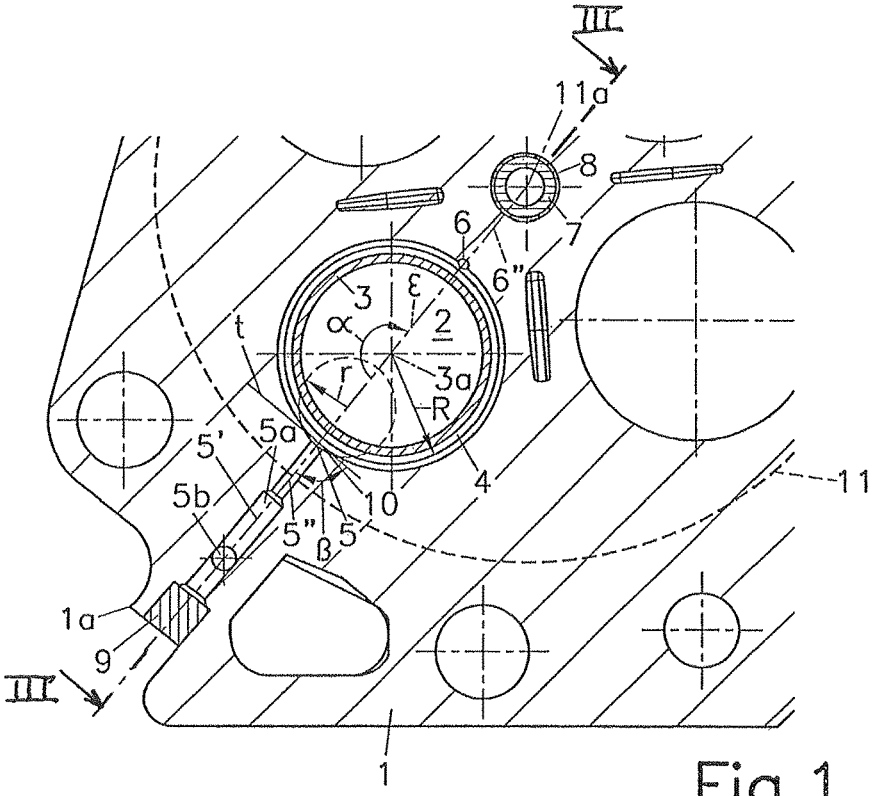
FIG. 1 shows a cylinder head according to the invention in a first embodiment in a section according to the line I-I in FIG. 3.

Parts having the same function are provided with the same reference numbers in the explanations.

The figures show a cylinder head 1 for at least one cylinder 11 of an internal combustion engine having at least one outlet valve 2 formed by a lifting valve not shown further (of which only the outlet valve opening is shown), wherein at least one valve seat ring 3 is disposed in the cylinder head 1, for example, pressed in, per outlet valve 2. The axis of the valve seat ring 3 is provided with reference number 3*a*. The valve seat ring 3 pressed in or glued in the cylinder head 1 is surrounded by an annular cooling channel 4 for a coolant which is formed, for example, milled into the cylinder head 1, which cooling channel extends between at least one inlet 5 and an outlet 6 over an angular region α of at least 180° around the valve seat ring 3. In the exemplary embodiments, the cooling channel 4 is executed circumferentially around the valve seat ring 3.

However, an interrupted design is also feasible. In this case, the inlet 5 is in communication with an inlet channel 5*a*, the outlet 6 is in communication with an outlet channel 6*a*, wherein inlet channel 5*a* and outlet channel 6*a* can be formed by bores. The inlet channel 5*a* starts from a side surfaces 1*a* of the cylinder head 1 and is directed radially towards the cylinder centre 11*a*. A component 7 opening centrally into the combustion chamber 14 of the cylinder 11—for example a spark plug or an injection device—is disposed in the region of the cylinder centre 11*a*, where the component 7 is at least partially surrounded by a cooling chamber 8. The outlet channel 6*a* opens into the cooling chamber 8.

FIG. 1 shows a first exemplary embodiment of a cylinder head 1, where the cooling channel 4 has a substantially crescent-shaped bulge 10 in the opening region of the inlet channel 5*a* into the cooling channel 4—i.e. in the region of the inlet 5. The bulge 10 can substantially have a circular segment shape and can be produced, for example, by a cutting turning tool, possibly a milling cutter. However a non-cutting manufacture, possibly by an electric erosion method, is also feasible. The radius r of the bulge is advantageously selected from the range $0.2 \cdot R \leq r \leq 0.8 \cdot R$ wherein preferably the radius r of the bulge 10 lies between preferably $0.4 \cdot R$ and $0.6 \cdot R$, By means of a bulge 10 configured in such a manner, flow losses in the region of the inlet 5 can be substantially reduced. A similar bulge can be provided in similar manner also in the region of the outlet 6 (not shown further). In FIG. 1 the bulge 10 is disposed symmetrically with respect to a plane ε running through the central line 5'.

Figure 2:
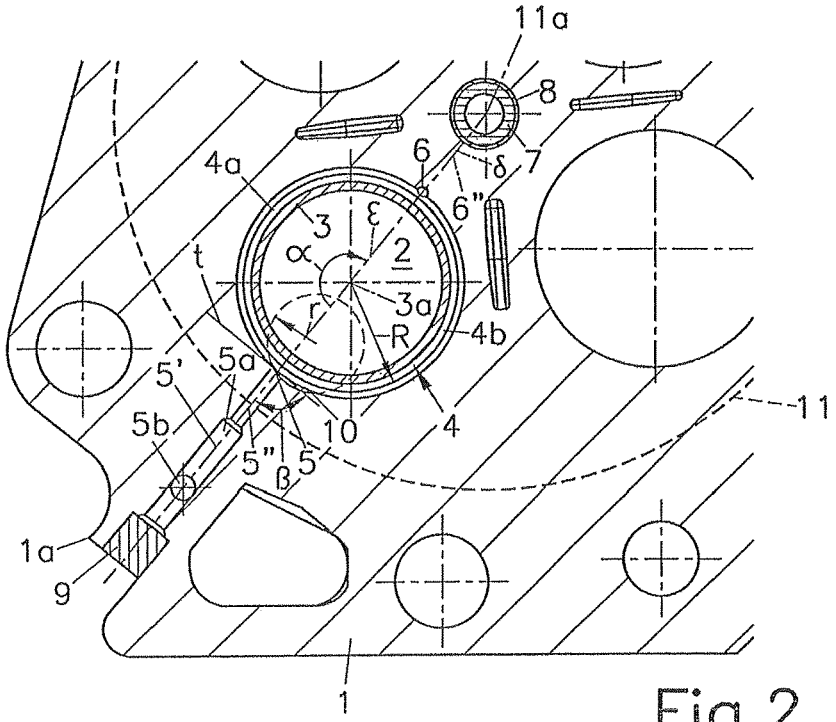
FIG. 2 shows a cylinder head according to the invention in a second embodiment in a section similar to FIG. 1.
Figure 3:
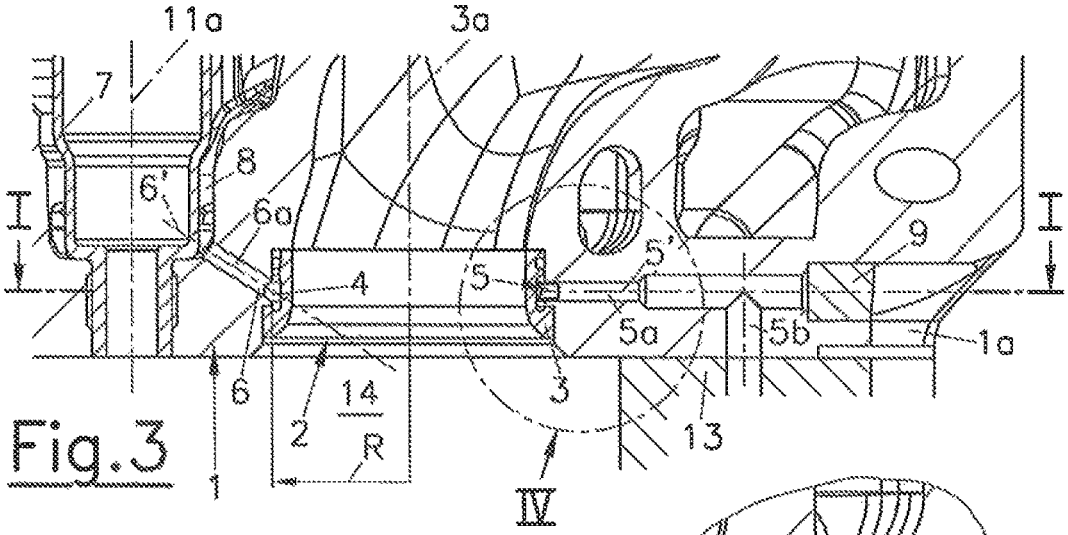
FIG. 3 shows the cylinder head in a section according to the line III-III in FIG. 1.
Figure 4:
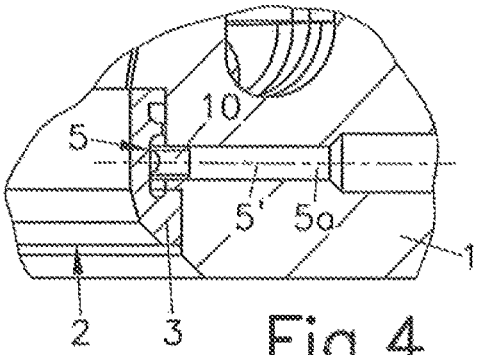
FIG. 4 shows the detail IV from FIG. 3.

FIG. 2 shows a second exemplary embodiment which differs from FIG. 1 in that the bulge 10 is disposed asymmetrically in relation to a meridian plane ε running through the centre 5" of the inlet 5 and/or a meridian plane δ of the valve seat ring 3 running through the outlet 6. As a result, on the one hand the flow losses during flow of the coolant into the cooling channel 4 are reduced and on the other hand an asymmetrical quantitative division of the coolant into the two annular subregions 4*a*, 4*b* of the cooling channel 4 is achieved. As a result, a higher heat removal can be achieved on one side of the meridian plane ε or δ than on the other side. In particular, the heat removal is increased on that side of the meridian plane ε, δ in which most of the crescent-shaped bulge 10 is disposed. FIG. 3 and FIG. 4 show the arrangement in a section in the meridian plane ε, δ, where the inlet 5 is shown in detail in FIG. 4.

Figure 5:
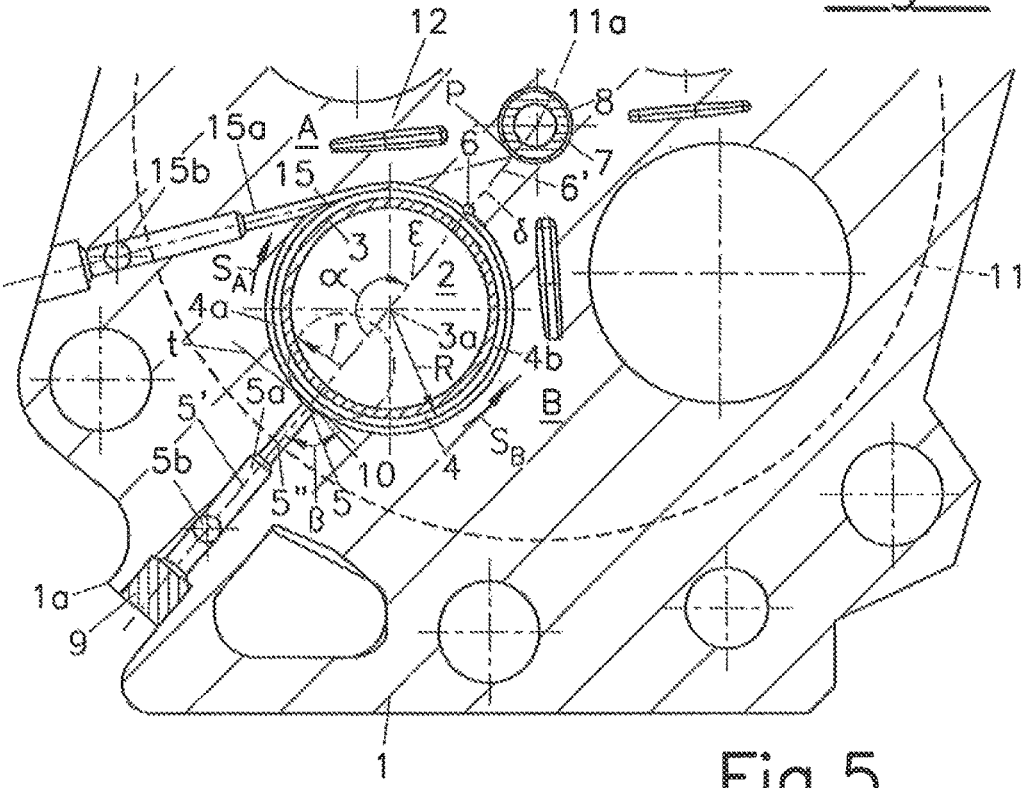
FIG. 5 shows a cylinder head according to the invention in a third embodiment in a section similar to FIG. 1.

FIG. 5 shows the cylinder head 1 in a third embodiment where, in addition to a radial inlet 5 having a radial inlet channel 5*a*, a tangential inlet 15 having a tangential inlet channel 15*a* is provided. The tangential inlet channel 15*a* opens tangentially into the annular cooling channel 4. As a result, a highly asymmetrically defined coolant flow is obtained in the cooling channel 4, where in accordance with the arrows $S_A$, $S_B$ a higher quantity of coolant flows through the subregion 4*a* of the cooling channel 4 facing the outlet valve bridge 12 than through the other away-facing subregion 4*b* so that the cylinder head 1 is cooled more strongly on the side A of the meridian plane ε or δ of the valve seat ring 3 than on the side B.

Figure 6:
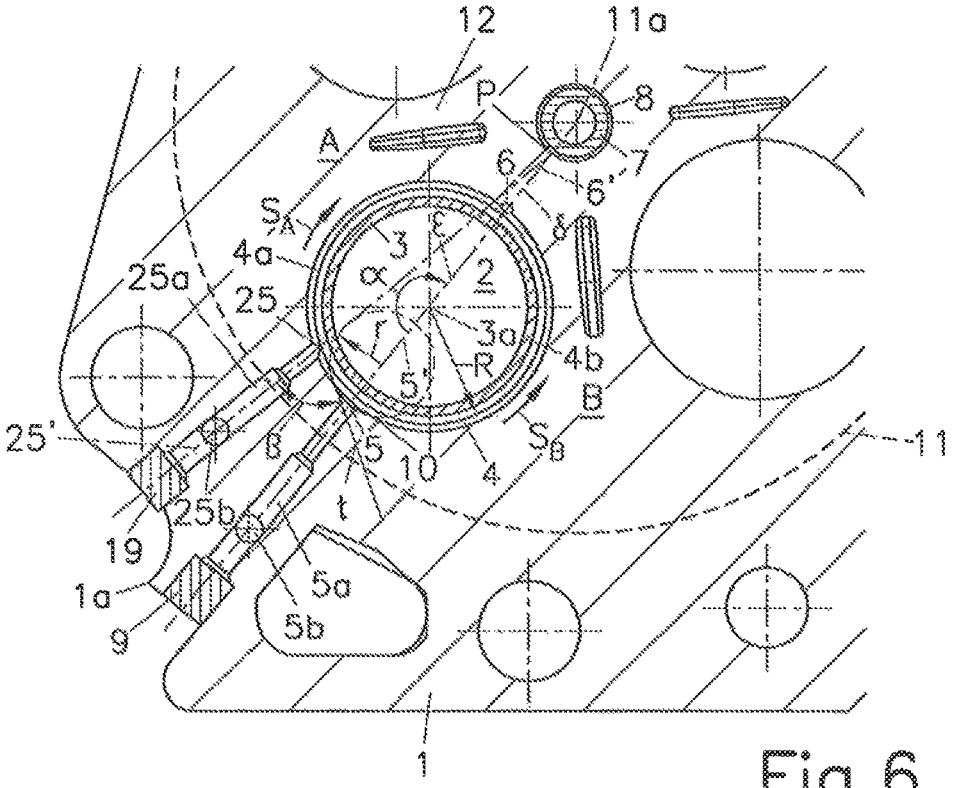
FIG. 6 shows a cylinder head according to the invention in a fourth embodiment in a section similar to FIG. 1.

FIG. 6 shows a fourth exemplary embodiment of the cylinder head 1, where similarly to FIG. 5, in addition to the radial inlet 5, a further inlet 25 with a further inlet channel 25*a* is provided. The further—sloping—inlet channel 25*a* opens on a side A of the plane ε or δ at an acute angle β into the annular cooling channel 4, where the angle ε between a tangent t on the annular cooling channel 4 in the region of the further—sloping—inlet 25 and the central line 25' of the second inlet channel 25 is spanned. The angle β is selected between 0° and 90°. In the exemplary embodiment the central line 25' of the sloping inlet channel 25*a* is disposed tangentially on a circle of curvature k having the radius of curvature r of a bulge 10 of the first inlet 5. As a result, a defined asymmetric coolant flow according to the arrows $S_A$, $S_B$ is obtained in the cooling channel 4, where a higher quantity of coolant flows through the subregion 4*a* of the cooling channel 4 facing the outlet valve bridge 12 than through the other away-facing subregion 4*b*. The cylinder head 1 is also cooled more strongly on the side A of the meridian plane ε or δ than on the side B.

Figure 7:
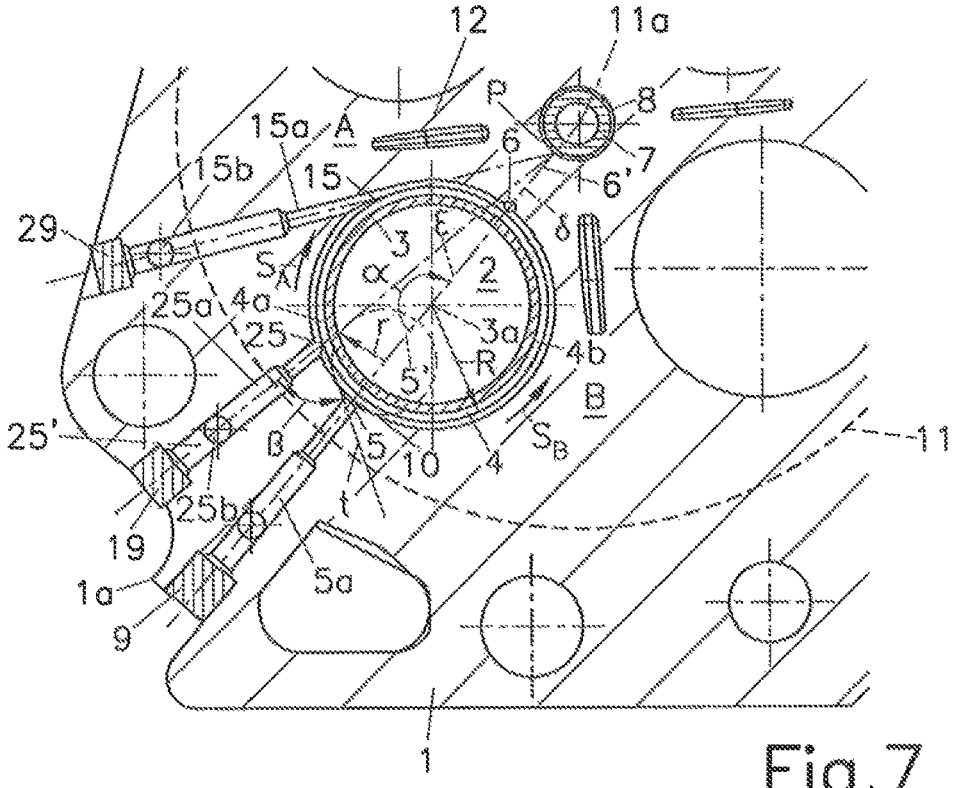
FIG. 7 shows a cylinder head according to the invention in a fifth embodiment in a section similar to FIG. 1.

FIG. 7 shows a fifth embodiment of the cylinder head 1 with a combination of the measures shown in FIG. 5 and FIG. 6. In addition to the radial inlet 5, two further inlets—namely a tangential inlet 15 and a sloping inlet 25 are provided, where the tangential inlet 15 comprises a tangential inlet channel 15*a* opening tangentially into the cooling channel 4 and the sloping inlet 25 has a sloping inlet channel 25*a* opening at an acute angle into the cooling channel 4. The sloping inlet channel 25*a* opens on a side A of the plane ε or δ at an acute angle β into the annular cooling channel 4, where the angle β between a tangent t on the annular cooling channel 4 in the region of the sloping inlet 25 and the central line 25' of the sloping inlet channel 25 is spanned. The angle β is selected between 0° and 90°. Both second inlet channels 15*a*, 25*a* open on a side A of the plane ε or δ into the annular cooling channel 4 which is facing the outlet valve bridge 12. As a result, a particularly strongly defined asymmetric coolant flow according to the arrows $S_A$, $S_B$ is obtained in the cooling channel 4, where a substantially higher quantity of coolant flows through the subregion 4*a* of the cooling channel 4 facing the outlet valve bridge 12 than through the other away-facing subregion 4*b*. The cylinder head 1 is thus cooled more strongly on the side A of the meridian plane ε than on the side B.

As is deduced from FIG. 5, FIG. 6 and FIG. 7, the inlet channels 5, 15, 25 are configured so that the central lines thereof 5', 15', 25' running through the respective inlets 5, 15, 25 intersect at a point P on a meridian plane δ of the valve seat ring 3 through the outlet 6. The point P is in this case favourably located in the region of the cooling jacket 8 of the component 7 which opens centrally into the combustion chamber 14. This enables simple manufacture with at the same time very effective heat removal from the region of the outlet valve bridge 12.

The bores for the first and second inlet channels 5*a*, 15*a*, 25*a* are closed subsequently in the region of the side surface 1*a* of the cylinder head 1 by stoppers 9, 19, 29.

The exemplary embodiments are shown in exemplary form with a single outlet 6 each. It is obvious that configurations with a plurality of outlets also lie within the scope of the invention.

Figure 8:
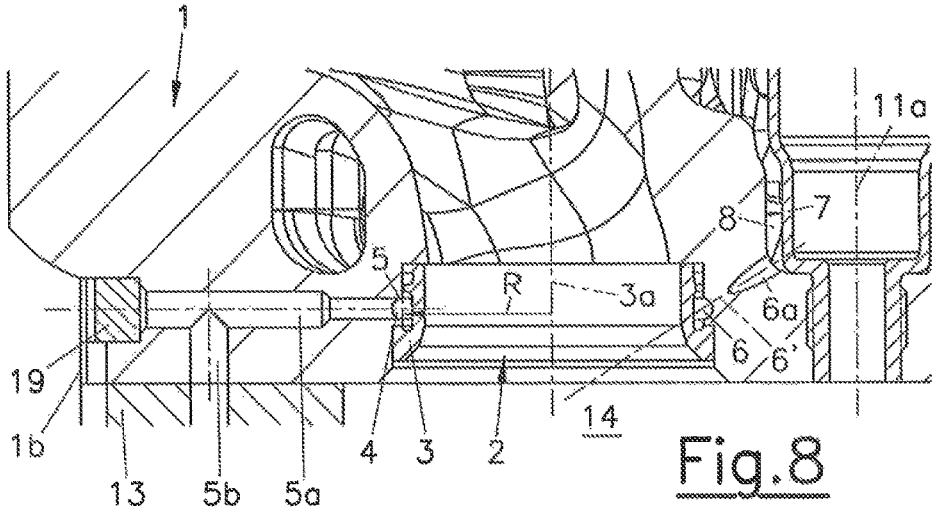
FIG. 8 shows the cylinder head according to the line VIII-VIII in FIG. 7.

The inlet channels 5*a*, 15*a*, 25*a* of the inlets 5, 15, 25 can be connected to a pressure source in the cylinder block 13 flange-mounted to the cylinder head 1 (indicated in FIG. 3 and FIG. 8) by means of vertical bores 5*b*, 15*b*, 25*b* so that the coolant flow takes place from the inlets 5, 15, 25 to the outlets 6. The outlet channel 6*a* of the outlet 6 can be fluidically connected via the cooling jacket 8 of the central component 7 to the cooling jacket 8 of the cylinder head 1. Alternatively to this, designs with inverse coolant flow from the outlets 6 to the inlets 5, 15, 25 are also feasible in which the outlets 6 are therefore connected to a pressure source and the inlets 5, 15, 25 are connected to a pressure sink. The range of protection of the present application covers all possible coolant flow directions.

Furthermore feasible within the framework of the present application are variants in which the cooling circuit for the cooling channels 4 for cooling the valve seat rings 3 is separate from the cooling circuit of the cylinder head 1. Consequently, different cooling media can be used for cooling the cylinder head 1 and for cooling the valve seat rings 3, for example, cooling water on the one hand and lubricating oil on the other hand.

The invention claimed is:

1. A cylinder head for an internal combustion engine having at least one cylinder, comprising:

a valve seat ring for a lifting valve, an annular cooling channel for a coolant formed at least partially into the cylinder head and at least partially surrounding the valve seat ring and extending between at least one inlet and at least one outlet, wherein the cooling channel, when as viewed in a section perpendicularly to an axis of the valve seat ring, has at least one substantially crescent-shaped bulge only in a region of at least one of the inlet and the outlet, and wherein $0.2 \cdot R \leq r \leq 0.8 \cdot R$, r being a radius of the bulge and R being a radius of the cooling channel.

2. The cylinder head according to claim 1, wherein the bulge has an at least partially substantially circular segment shape.

3. The cylinder head according to claim 2, wherein the bulge is produced by a turning tool.

4. The cylinder head according to claim 1, wherein the bulge is disposed asymmetrically in relation to a meridian plane (β, δ) running through a centre of the inlet or outlet.

5. The cylinder head according to claim 1, wherein said at least one inlet opens at an angle β into the cooling channel, wherein the angle β between a central line of an inlet channel leading to said at least one inlet and a tangent (t) to the cooling channel in a region of said at least one inlet is spanned, and wherein $0 \leq \beta \leq 90°$.

6. The cylinder head according to claim 5, wherein said at least one inlet opens radially into the cooling channel so that $\beta = 90°$.

7. The cylinder head according to claim 5, wherein said at least one inlet opens tangentially into the cooling channel and $\beta = 0°$.

8. The cylinder head according to claim 5, wherein said at least one inlet opens obliquely into the cooling channel and $0 \leq \beta \leq 90°$.

9. The cylinder head according to claim 8, wherein a central line of the inlet opening obliquely into the cooling channel is disposed tangentially to a circle of curvature of a bulge of a further inlet.

10. The cylinder head according to claim 9, wherein the further inlet opens radially into the cooling channel.

11. The cylinder head according to claim 1, wherein the inlet is disposed diametrically to the outlet in relation to the axis of the valve seat ring.

12. The cylinder head according to claim 11, wherein the inlet is a radial inlet which opens radially into the cooling channel.

13. The cylinder head according to claim 1, wherein said at least one inlet is disposed on a first side of a meridian plane (δ) of the valve seat ring through the outlet facing an outlet valve bridge.

14. The cylinder head according to claim 13, wherein the inlet opens tangentially into the cooling channel and/or the inlet opens obliquely into the cooling channel.

15. The cylinder head according to claim 1, wherein a plurality of inlets open into the cooling channel.

16. The cylinder head according to claim 15, wherein the inlets are arranged asymmetrically in relation to a meridian plane of the valve seat ring through the outlet.

17. The cylinder head according to claim 1, wherein at least two inlet channels are positioned so that central lines thereof extending through the respective inlets intersect at a point on a meridian plane (δ) of the valve seat ring through the outlet and/or at a point in the region of a cooling jacket of a component, which opens into a combustion chamber.

18. The cylinder head according to claim 17, wherein the component is an injection device.

19. The cylinder head according to claim 17, wherein the component opens centrally into a combustion chamber.

20. The cylinder head according to claim 1, wherein the cooling channel of the valve seat ring is separate from a cooling system of the cylinder head.

21. The cylinder head according to claim 1, wherein $0.4 \cdot R \leq r \leq 0.6 \cdot R$.

* * * * *